US011465189B2

(12) United States Patent
Stein

(10) Patent No.: US 11,465,189 B2
(45) Date of Patent: Oct. 11, 2022

(54) DEVICE FOR CHANGING BENDING TOOLS IN A BENDING MACHINE FOR BENDING METAL SHEETS

(71) Applicant: BYSTRONIC LASER AG, Niederönz (CH)

(72) Inventor: Christian Stein, Seengen (CH)

(73) Assignee: BYSTRONIC LASER AG, Niederönz (CH)

( * ) Notice: Subject to any disclaimer, the term of this patent is extended or adjusted under 35 U.S.C. 154(b) by 0 days.

(21) Appl. No.: 17/635,137

(22) PCT Filed: Jul. 14, 2020

(86) PCT No.: PCT/EP2020/069839
§ 371 (c)(1),
(2) Date: Feb. 14, 2022

(87) PCT Pub. No.: WO2021/032365
PCT Pub. Date: Feb. 25, 2021

(65) Prior Publication Data

US 2022/0266324 A1 Aug. 25, 2022

(30) Foreign Application Priority Data

Aug. 19, 2019 (DE) ..... 10 2019 212 341.4

(51) Int. Cl.
*B21D 5/02* (2006.01)
*B21D 37/14* (2006.01)

(52) U.S. Cl.
CPC ..... *B21D 5/0254* (2013.01); *B21D 37/145* (2013.01)

(58) Field of Classification Search
CPC .... B21D 37/04; B21D 5/0254; B23Q 3/1556; B23Q 3/15573; B23Q 3/1554;
(Continued)

(56) References Cited

U.S. PATENT DOCUMENTS 4,658,625 A 4/1987 Koyama et al.
10,293,394 B2 5/2019 Sato
2019/0337255 A1* 11/2019 Tarasconi ..... B21D 37/145

FOREIGN PATENT DOCUMENTS

EP 2138247 B1 12/2014
EP 2865458 A1 4/2015
(Continued)

OTHER PUBLICATIONS

SATO, Translation of WO-2014061773-A1 (Year: 2014).*
(Continued)

*Primary Examiner* — Jessica Cahill
*Assistant Examiner* — Bobby Yeonjin Kim
(74) *Attorney, Agent, or Firm* — Workman Nydegger

(57) ABSTRACT

The invention relates to a device for changing bending tools (15, 16) in a bending machine (2) for bending metal sheets, in particular in a press brake, comprising at least one tool magazine (6) for storing the bending tools (15, 16), which, when positioned in a working area of the bending machine (2), cause the metal sheets to bend. The at least one tool magazine (6) is arranged on a frame (3) which is configured to be positioned in a free-standing manner without a mechanical connection to the bending machine (2) in an operating position of the device (1), wherein the at least one tool magazine (6) can be moved from a first position out of the frame (3) into a second position, in which at least a part of the tool magazine (6) that can be moved out lies in a contact-free manner within the bending machine (2).

15 Claims, 9 Drawing Sheets

(58) Field of Classification Search
CPC ..... B23Q 3/15513; B23Q 3/1552; B23Q 3/15526; B23Q 2003/15532; B23Q 2003/15527
USPC ..... 483/901, 902
See application file for complete search history.

(56) References Cited

FOREIGN PATENT DOCUMENTS

| | | | | |
|---|---|---|---|---|
| WO | WO-2014061773 | A1 * | 4/2014 | ..... B21D 37/145 |
| WO | 2017/212386 | A1 | 12/2017 | |
| WO | 2018/112493 | A1 | 6/2018 | |
| WO | 2018/138598 | A1 | 8/2018 | |

OTHER PUBLICATIONS

International Search Report and Written Opinion, dated Oct. 22, 2020, for PCT/EP2020/069839, filed Jul. 14, 2020.
International Preliminary Report on Patentability, dated Nov. 5, 2021, for PCT/EP2020/069839, filed Jul. 14, 2020.

* cited by examiner

DEVICE FOR CHANGING BENDING TOOLS IN A BENDING MACHINE FOR BENDING METAL SHEETS

The invention relates to a device for changing bending tools in a bending machine for bending metal sheets, in particular in a press brake. The invention further relates to an arrangement comprising such a device and a bending machine.

It is known from the prior art to attach tool magazines to bending machines, wherein bending tools can be automatically exchanged between the tool magazines and the bending machine by means of a changing device. In this way, a bending machine can be automatically configured for a new bending process by exchanging the bending tools.

The problem with conventional changing devices for changing bending tools in bending machines is that they are often integrated in the bending machine together with the corresponding tool magazines, so that vibrations are transmitted between the bending machine and the changing device. There are approaches to arrange the tool magazines separately from the bending machine. However, this increases the effort for changing the bending tools.

The document EP 2 138 247 B1 discloses a tool deposit which is arranged on the side next to a bending machine. Bending tools can be exchanged between the tool deposit and the bending machine via a movable manipulator. The manipulator is also used as a bending robot to carry out bending operations.

A storage device for bending tools of a bending machine is disclosed in the document EP 2 865 458 A1. The storage device is arranged on the side next to the bending machine and comprises a multitude of movable receptacles for storing bending tools.

The document U.S. Pat. No. 4,658,625 A discloses a bending machine having a height-adjustable storage rack for bending tools, which can be exchanged between the storage rack and a working area of the bending machine via a changing device.

The document U.S. Pat. No. 10,293,394 B2 discloses a bending machine having a storage device for bending tools on the rear side of the bending machine and a changing device in order to exchange tools between the storage device and a working area of the bending machine.

Document WO 2017/212386 A1 discloses a tool storage unit for a bending press having several frames for storing tools. The frames can be moved in a horizontal direction. Furthermore, each frame can also be lifted in the vertical direction when positioned in a reference position for lifting. The tool storage unit comprises a mounting drive for picking up tools out of a lifted frame. The mounting drive comprises a trolley being movable along a horizontal guide.

Document WO 2018/112493 A1 describes a tool storage device comprising a plurality of drawers having storage rails for storing tools of a bending machine. The storage device is positioned adjacent to a side wall of the bending machine and the drawers can be pulled by an operator out of the storage device via handles at the front of the drawers.

Document WO 2018/138598 A1 discloses a robot for changing bending tools in a bending machine. The tools are stored in storage magazines, each comprising a rack and shelves. The storage magazines are located at lateral positions behind the bending machine.

The task of the invention is to provide a device for changing bending tools in a bending machine for bending metal sheets and a corresponding arrangement of such a device and a bending machine, which enable simple exchange of bending tools and at the same time suppress the transmission of vibrations between the changing device and the bending machine as much as possible.

This task is achieved by the device according to claim 1 or the arrangement according to claim 14. Further developments of the invention are defined in the dependent claims.

The device according to the invention is used for changing bending tools in a bending machine for bending metal sheets, in particular in a press brake. The device contains at least one tool magazine for storing the bending tools which, when positioned in a working area of the bending machine, cause the corresponding metal sheets to bend.

In the device according to the invention, the at least one tool magazine is arranged on a frame, i.e. on a carrier or supporting part of the device. The frame is configured to be positioned in a free-standing manner without a mechanical connection to the bending machine in an operating position of the device, i.e. there is no force, form or material connection in the operating position and preferably also no mechanical contact between (i.e. they do not touch) between any component of the device and any component of the bending machine. In other words, the frame is shaped in such a way that it can be positioned in a free-standing manner relative to the bending machine in a corresponding operating position without a mechanical connection between the device and the bending machine. The above-mentioned operating position is distinguished by the fact that it is the position of the device in which it is operated as intended for changing bending tools.

Furthermore, a robot is arranged on the frame of the device according to the invention for automatically inserting the bending tools from the at least one tool magazine into the working area of the bending machine and for automatic storage of the bending tools from the working area in the at least one tool magazine, wherein the robot, during operation of the device, moves in the operating position between the at least one tool magazine and the working area of the bending machine, in order to automatically insert and automatically store the bending tools.

In the device according to the invention, the at least one tool magazine can be moved out of the frame of the device from a first position into a second position, in which at least a part of the tool magazine that can be moved out lies in a contact-free or non-contact manner within the bending machine when the device is in the operating position. In other words, at least a part of the tool magazine that can be moved out lies within the bending machine without the at least one tool magazine that can be moved out touching or coming into contact with the bending machine.

The device according to the invention has the advantage that it can be operated mechanically decoupled from the bending machine, so that the transmission of vibrations and shocks between the device and the bending machine is largely suppressed. At the same time, good accessibility to the tool magazines is achieved in that they can be at least partially moved out of the frame of the device. Furthermore, the dimensions of the device for transportation are significantly reduced.

The robot provided in the device can be any automated machine that is used to change the bending tools. The travel paths of the robot are short due to the at least one tool magazine that can be moved out, which in turn leads to short cycle times. In the operating position of the device, the working area is preferably reached by the robot via an (at least partially open) rear side of the bending machine, wherein the rear side is opposite a front side of the bending machine, via which the metal sheets to be bent are fed to the working area during operation of the bending machine.

Depending on the configuration, the feature of the at least one tool magazine that can be moved out can be realised in different ways. In a preferred variant, the at least one tool magazine that can be moved out is displaceably guided in the frame, preferably via one or more guide rails and particularly preferably via two guide rails. A displaceable tool magazine ensures that the tool magazine can be moved out of the frame in a simple and space-saving manner. Alternatively, it is also possible for the at least one tool magazine that can be moved out to be moved out of the frame by means of a rotary or pivoting movement.

In a further variant of the device according to the invention, the at least one tool magazine that can be moved out can be moved out of the frame manually (i.e. with the help of an operator). Nevertheless, it is also possible for the tool magazine that can be moved out to be moved out of the frame automatically (i.e. by means of a corresponding actuator). In this way, setting up the device in the operating position can be accelerated.

In a further preferred embodiment, the at least one tool magazine that can be moved out is assigned a fixing device for fixing the tool magazine to the frame in the moved-out state. The fixing prevents the position of the tool magazine from changing during operation, for example due to vibrations. The bending tools can thus be reliably stored and removed again, by means of the robot, in the corresponding tool magazine.

In a further particularly preferred embodiment, a plurality of tool magazines that can be moved out are provided, which are arranged on one or a plurality (in particular two), preferably vertically extending inner sides of the frame, which adjoin an opening area of the device. As a result, a high storage capacity for bending tools to be stored can be achieved. The robot described above preferably enters the bending machine during operation of the device via the opening area.

In a further preferred embodiment, in addition to the at least one tool magazine that can be moved out, at least one further tool magazine is immovably attached to the frame, i.e. there is also at least one firmly fixed tool magazine that cannot be moved out. The at least one other tool magazine has the same purpose as the at least one tool magazine that can be moved out, i.e. it is used for storing bending tools, wherein the removal of the bending tools from the immovable tool magazine and the storage of the bending tools in the immovable tool magazine can be carried out with the robot arranged on the frame of the device according to the invention.

The at least one immovable tool magazine is preferably arranged on an inner side of the frame, which lies opposite an opening area of the device. With this embodiment, the capacity for bending tools to be stored can be further increased. The robot described above preferably enters the bending machine during operation of the device via the opening area.

In a particularly preferred embodiment, the robot arranged on the frame is a multi-axis robot having a plurality of robot axes and joints between the robot axes and a gripping device for gripping a bending tool. By using a multi-axis robot, the device can be used flexibly for bending machines of different types, since the robot movement can be varied flexibly.

In a preferred embodiment, in which a multi-axis robot is used for inserting or storing bending tools, the device is assigned a gripping station for temporarily receiving a bending tool during a gripping action of the robot, wherein by means of the gripping action a gripping position of the bending tool used by the robot is changed from one side to the other side of the bending tool. Instead of or in addition to the gripping station, the device can also be assigned a turning station for temporarily receiving a bending tool and for automatically turning the temporarily received bending tool, so that the temporarily received bending tool can be gripped on another side of the bending tool after the robot has turned it. In this way it is possible to use bending tools in different orientations in the working area of the bending machine, which increases the possibilities of adapting the bending process carried out with the bending machine. In a variant, the gripping station and/or the turning station are mechanically connected to the device according to the invention. Nevertheless, the gripping station and/or the turning station can also be arranged without a mechanical connection to the device according to the invention, for example on the bending machine.

In a further preferred variant, the device is assigned an anchoring means for anchoring it to the floor in the operating position. In this way, a secure work level of the device is guaranteed during its operation.

In a further embodiment, the device has a control module for the robot. The control module is intended to control the automatic insertion and storage of the bending tools by the robot. The device thus has an independent control unit, which enables its use in combination with different bending machines.

In a preferred variant, the control module contains a communication interface, via which the control module can communicate with a control device of the bending machine. In this way, a coordination of the bending process with the corresponding tool change can be achieved by data exchange between the control module of the device and the control device of the bending machine.

In a further embodiment, the robot includes a sensor device, wherein the control module is able to control the robot for storing the bending tools in such a way that the robot detects bending tools to be stored in the working area of the bending machine by means of the sensor device and subsequently transports the bending tools to be stored from the working area into a tool magazine. In this way, bending tools can be stored in a simple manner. This variant is particularly advantageous if, in the operating position of the device, the working area is reached by the robot via a rear side of the bending machine.

The invention also relates to an arrangement of the bending machine and the device for changing bending tools, wherein the device has at least one tool magazine for storing the bending tools, which, when positioned in a working area of the bending machine, cause the metal sheets to bend. In the arrangement according to the invention, the at least one tool magazine is arranged on a frame which is positioned in a free-standing manner without a mechanical connection to the bending machine in an operating position of the device.

Furthermore, in the arrangement according to the invention, a robot is arranged on the frame of the device for automatically inserting the bending tools from the at least one tool magazine into the working area of the bending machine and for automatic storage of the bending tools from the working area in the at least one tool magazine, wherein the robot, during operation of the device, moves in the operating position between the at least one tool magazine and the working area of the bending machine, in order to automatically insert and automatically store the bending tools. Moreover, the at least one tool magazine can be moved out of the frame from a first position into a second position, in which at least a part of the tool magazine that can be moved out lies in a contact-free manner within the bending machine.

The arrangement according to the invention is thus characterised by a bending machine and the above-described device according to the invention for changing bending tools, which is arranged in the operating position. In a preferred variant of this arrangement, the device for changing bending tools is designed in accordance with one or more of the preferred variants described above.

An exemplary embodiment of the invention is described in detail below with reference to the accompanying figures.

An embodiment of the invention is described below on the basis of a changing device for bending tools in a bending machine in the form of a press brake. It should be noted that only those components of the figures that are relevant to the invention are described in detail below. Furthermore, the figures also contain a Cartesian coordinate system with orthogonal axes in the form of an x-axis, y-axis and z-axis. With this coordinate system, the orientation is illustrated in the corresponding representation. The x-axis extends from the rear side to the front side of the bending machine, whereas the y-axis extends in the transverse direction of the bending machine. The z-axis indicates the extent in the horizontal direction (i.e. along the acceleration due to gravity).

Figure 1:
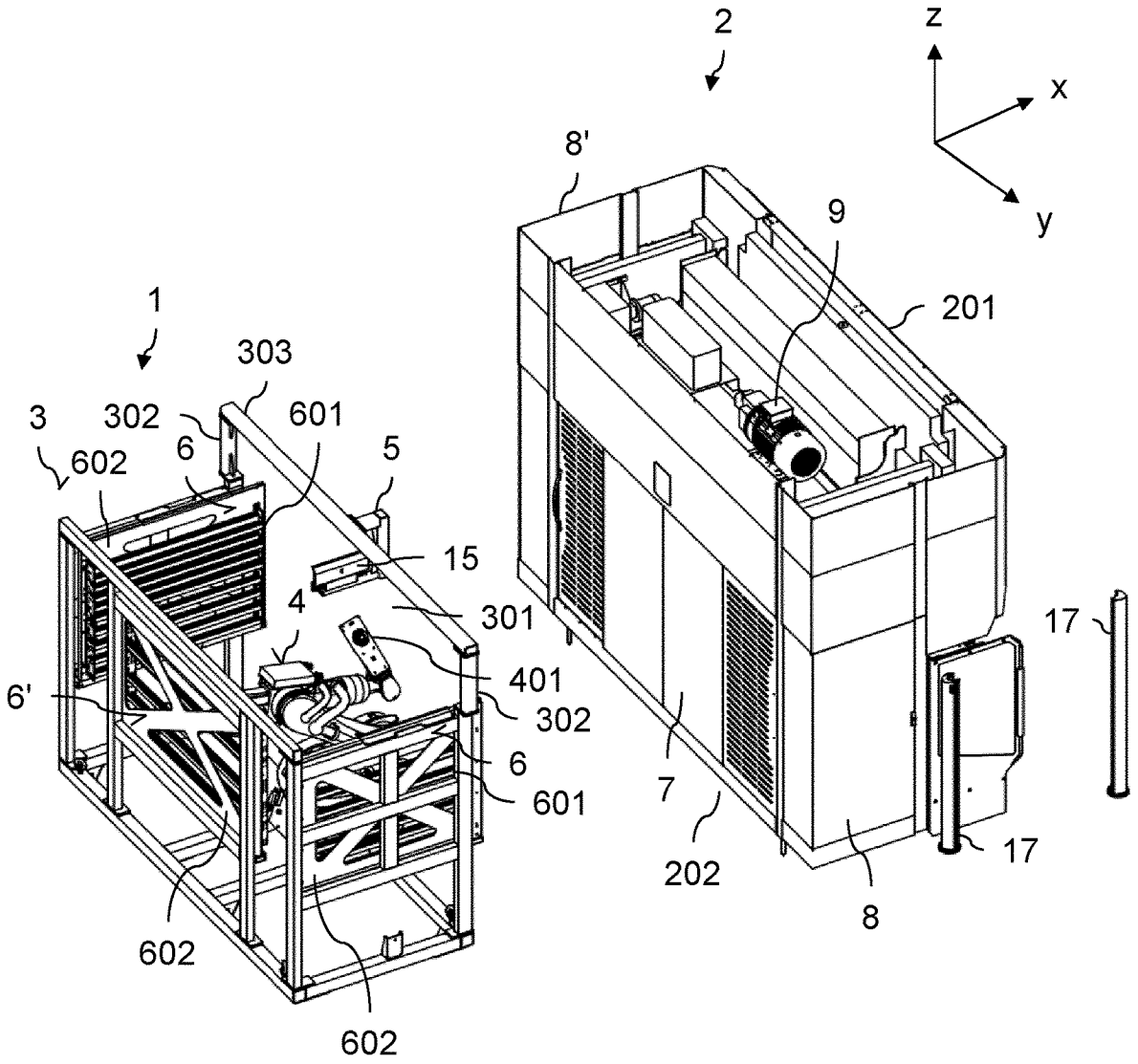
FIG. 1 shows a perspective representation of an embodiment of a changing device according to the invention together with a corresponding bending machine.

FIG. 1 shows a perspective view of the changing device 1 without formwork and a corresponding bending machine in the form of a press brake 2, the bending tools of which are to be changed with the changing device 1. The front side of the bending machine is identified by reference sign 201 and the rear side by reference sign 202. As can be seen from FIG. 1, the changing device 1 has a frame 3 which carries both a multi-axis robot 4 and a plurality of tool magazines 6 and 6'. The frame is made of solid steel. The frame 3 has an opening area 301, which lies opposite the rear side 202 of the bending machine 2. The robot 4 can enter the bending machine via its rear side 202 using this opening area when the formwork 7 is removed, as will be described in more detail below.

The tool magazines contain two tool magazines 6 arranged on opposite inner sides of the frame 3, which are guided with corresponding guides and can be extended in the horizontal direction towards the bending machine 2, as will be described in more detail below. In addition, the frame 3 carries a further fixed tool magazine 6', which is provided behind the robot 4 on an inner side of the frame. Each of the tool magazines 6 and 6' has a magazine frame 602 and a multitude of receptacles 601, in which bending tools of the bending machine can be positioned when they are not in use. For the sake of clarity, only a part of the receptacles is designated with the corresponding reference sign 601 in all figures. To save weight, the magazine frame 602 of the tool magazines 6 or 6' has four triangular recesses.

The robot 4 positioned centrally in the frame 3 is a multi-axis robot with corresponding joints between the axes and an end effector, which includes a pneumatically actuated gripping device 401 in the form of a parallel gripper having two parallel, mutually movable gripping blocks. The corresponding bending tools can be gripped via the parallel gripper 401 and then moved by means of the robot between storage positions in the tool magazines and working positions in the bending machine, as will be described in more detail below.

The frame 3 has two vertical struts 302 in the upper region, which are connected to one another via a horizontal strut 303. In the middle of the horizontal strut 303, there is a gripping station 5, on which bending tools, which can be inserted into the bending machine in two different orientations, can be temporarily stored. While the corresponding bending tool is temporarily stored, the robot changes its gripping position from one side of the bending tool to the other side, so that the bending tool can then be rotated about 180° and inserted into the corresponding working position in the bending machine. In the embodiment of FIG. 1, an upper tool 15 is shown as an example, which is stored on the gripping station. This upper tool and corresponding lower tools are described in more detail below.

The bending machine 2 shown in FIG. 1 has two interconnected side stands 8 and 8'. Furthermore, a formwork 7 is provided on the rear side of the bending machine, which is removed from the bending machine 2 for the commissioning of the changing device 1, as will be described in more detail below. Furthermore, FIG. 1 shows a hydraulic pump 9 in the upper region of the bending machine 2. With this hydraulic pump, an upper beam 13 with upper tools 15 inserted therein is moved to a lower beam 14 with lower tools 16 inserted therein, in order to thereby bring about the bending of a metal sheet. This is described in more detail below with reference to FIG. 4, which also shows the upper beam and lower beam as well as the upper tools and lower tools used.

FIG. 1 also shows two posts 17 which are positioned on one side of the bending machine 2. In a similar way, corresponding posts are also arranged on the other side of the bending machine, wherein these posts are covered by the bending machine. The post arranged adjacent to the side stand 8 emits light radiation, which is deflected by means of the other post shown, so that it extends along the y-axis. A corresponding post on the side of the side stand 8' then deflects this radiation again, so that the radiation then extends along the x-axis to a further post on which there is a receiving device for the emitted light. In this way, a light fence is created, wherein when a system operator penetrates into the light fence, a bending process that has just been carried out with the bending machine is interrupted. This creates a protective mechanism for workers on the bending machine. Such a protective mechanism can possibly also be achieved in another way, for example via a protective door on the front side of the bending machine.

Figure 2:
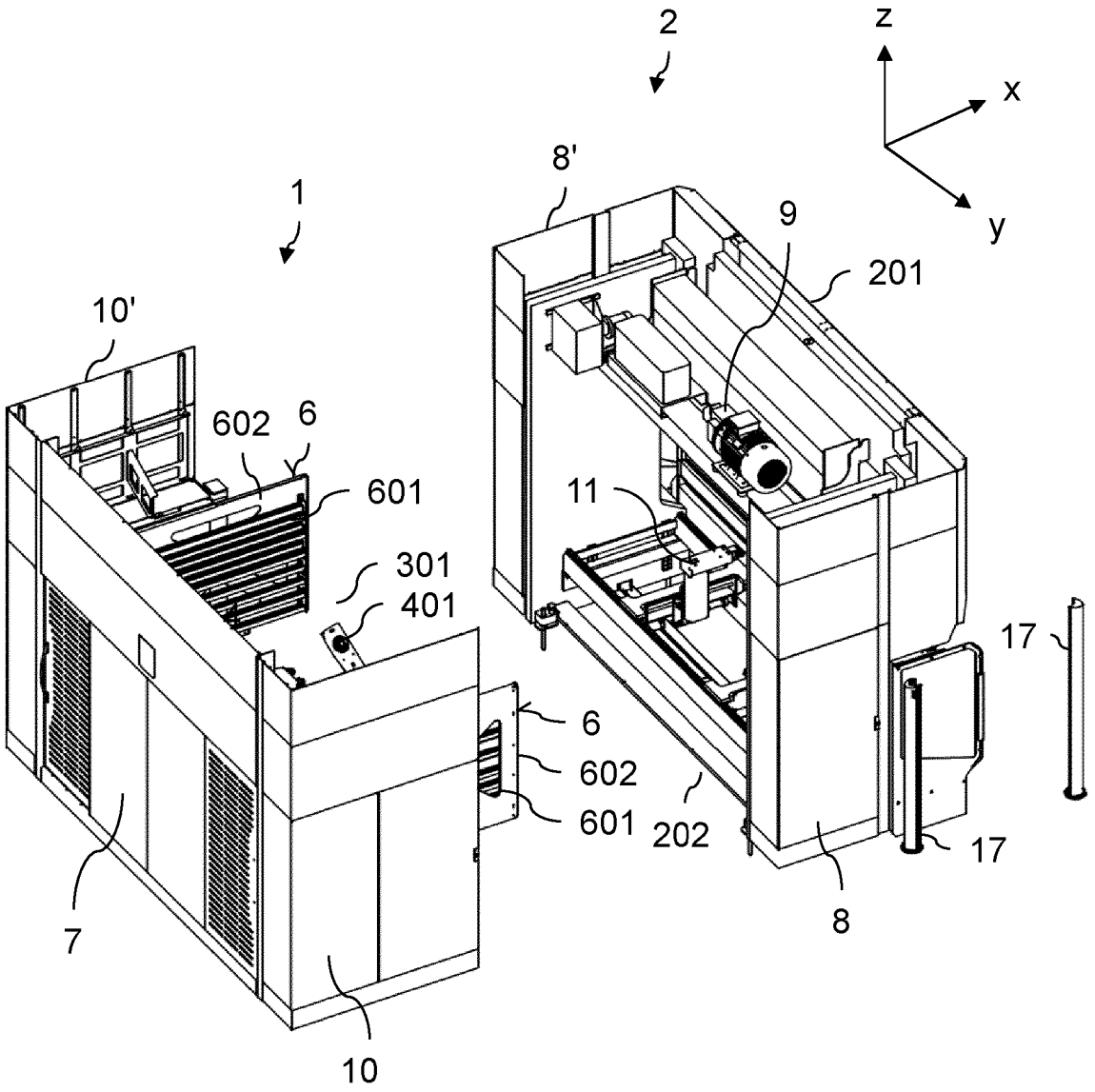
FIG. 2 shows a perspective representation corresponding to FIG. 1, wherein the rear side of the bending machine is opened.

FIG. 2 shows a perspective view analogous to FIG. 1, wherein the formworks 10 and 10' are now provided on both sides of the frame 3 of the changing device 1. For the sake of clarity, the gripping station 5 and the struts 302 and 303 have been omitted in FIG. 2 and also in FIG. 3 described below. Both the formwork 10 and the formwork 10' are spaced apart from the corresponding adjacent side of the frame 3. This creates two gaps, wherein a control module (not shown) of the changing device is arranged in one of the two gaps, by means of which the movements of the robot for storing and retrieving bending tools are controlled.

In addition, in the representation in FIG. 2, the formwork 7 is removed from the rear side 202 of the bending machine 2. The frame 3 is designed such that the formwork 7 can be attached to the rear side of the frame, as indicated in FIG. 2. It can also be seen from FIG. 2 that the two tool magazines 6 can be extended. The magazines are shown in FIG. 2 in the extended state, in which they protrude from the front side of the frame 3 or from the opening area 301. In contrast, the magazines 6 in the representation of FIG. 1 are shown in the retracted state, in which they do not protrude from the frame. The two tool magazines 6 are extended manually via the operation of a system operator. Nevertheless, it may also be possible to provide a mechanism for automatically extending the tool magazines 6 by means of a suitable actuator. In the depicted extended state of the tool magazine, the changing device 1 is operated. Before commissioning, the two tool magazines 6 are fixed to the frame 3, wherein corresponding screws are used for this purpose in the embodiment described here, by means of which the magazines are screwed to the frame in the extended position.

According to the representation in FIG. 2, the bending machine 2 now has an open rear side 201 due to the removal of the formwork 7. This shows part of the interior of the bending machine. In particular, a stop 11 can be seen, against which a metal sheet strikes during the bending process. In a position offset in the y-direction there is a further stop which is concealed in FIG. 2, but can be seen from FIG. 4 described further below.

Figure 3:
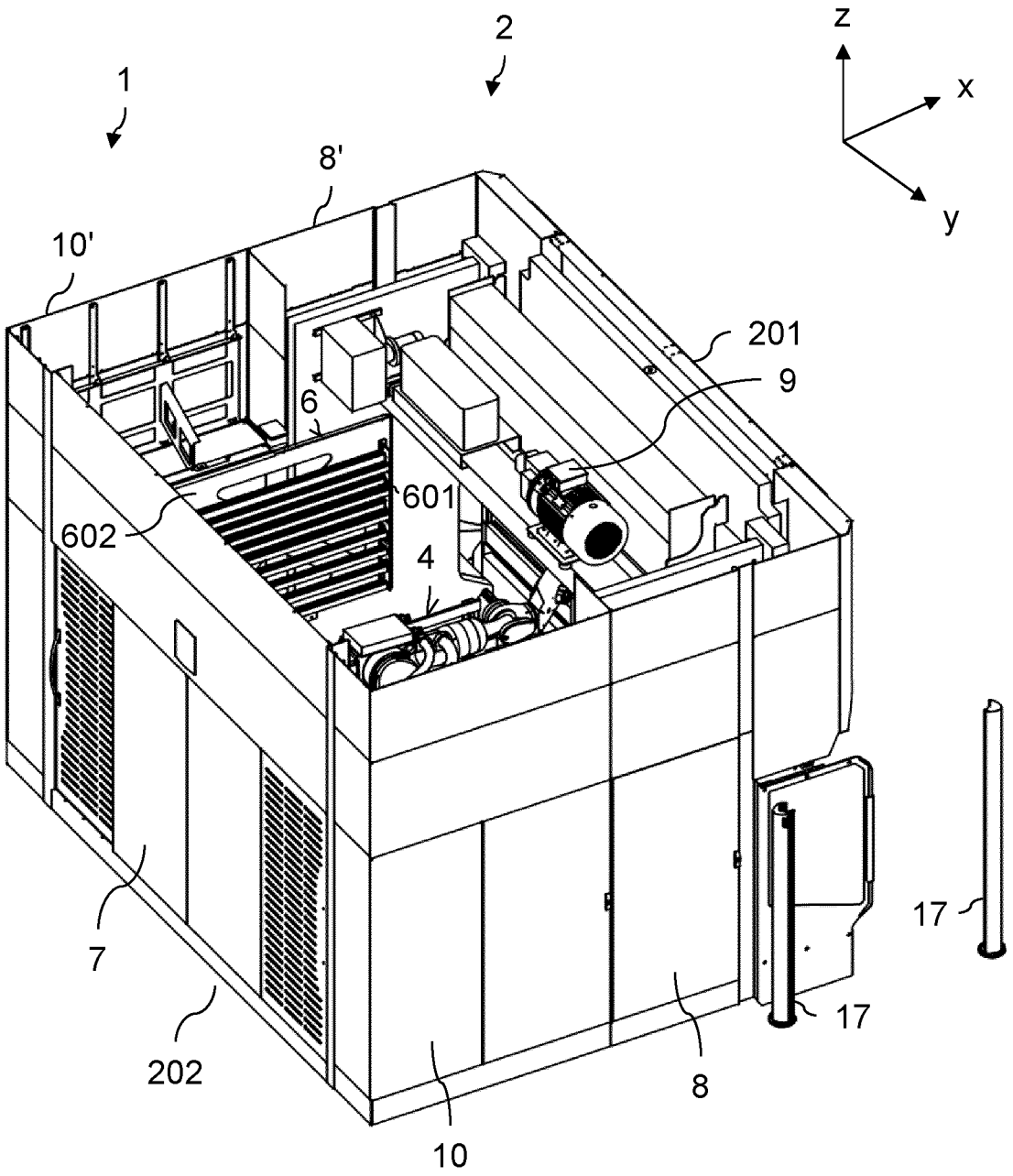
FIG. 3 shows a perspective representation which shows the changing device and the bending machine from FIGS. 1 and 2 in the operating position of the changing device.

FIG. 3 shows a perspective view of the arrangement of the changing device 1 and the bending machine 2 in the operating position of the changing device. As already mentioned above, the two tool magazines 6 are in the extended state, so that they can be very easily reached by the robot 4 when changing the bending tools. Furthermore, it is ensured that, in the operating position of FIG. 3, no components of the changing device 1 and in particular not the extended tool magazines 6 have any mechanical contact with (i.e. they do not touch) the bending machine 2. There is therefore no force, form or material connection between the changing device and the bending machine. In this way, it is achieved that vibrations and shocks are not transmitted from the bending machine 2 to the changing device 1 and vice versa.

Figure 4:
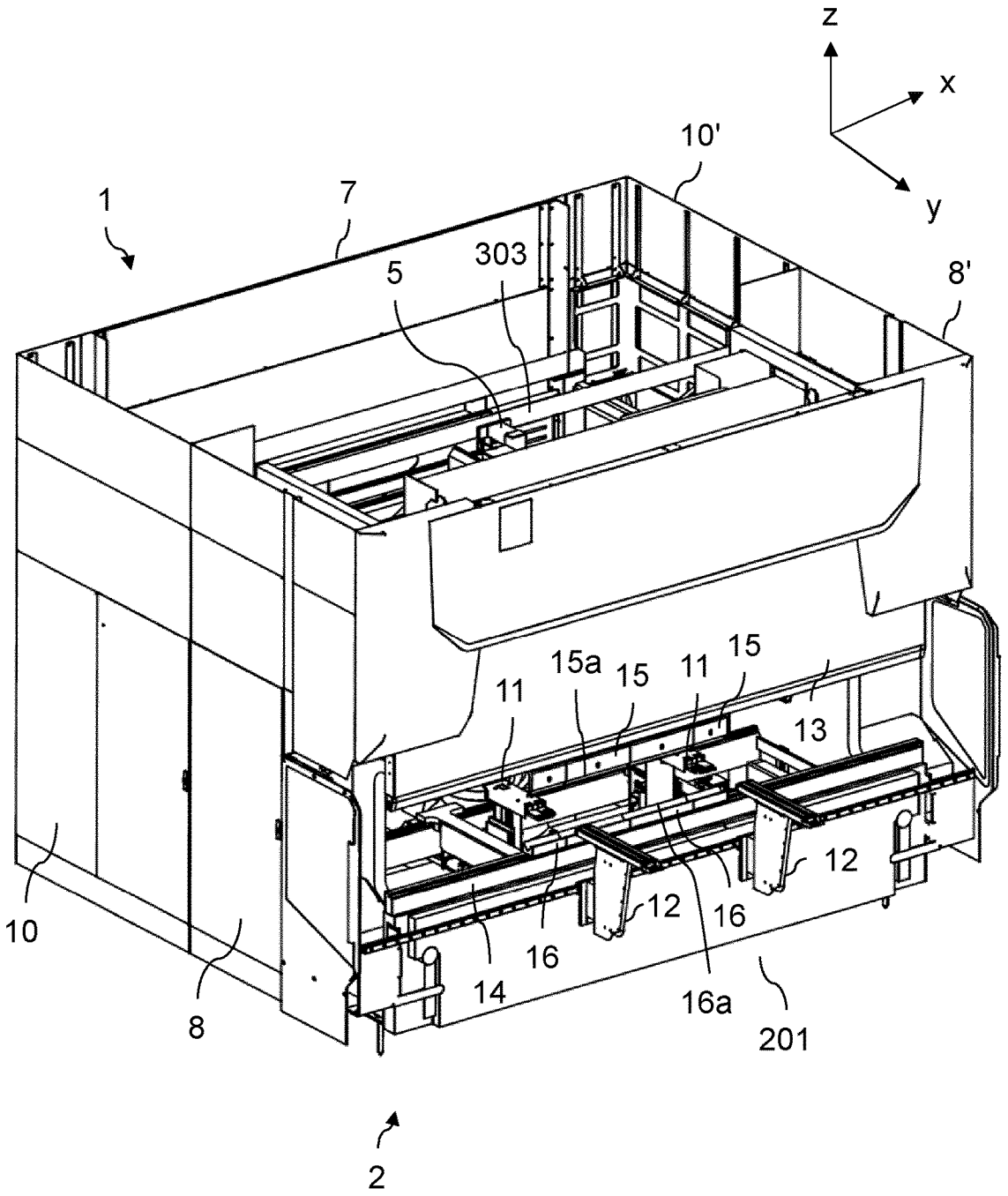
FIG. 4 shows a perspective view of the bending machine from FIG. 3 from the front side.

FIG. 4 shows a perspective view of the arrangement from FIG. 3 viewed in the direction of the front side 201 of the bending machine 2. A metal sheet to be machined is inserted via this front side by an operator, wherein the metal sheet is placed on two metal sheet supports 12 for this purpose. If necessary, it is also possible for the metal sheet to be handled by a bending robot instead of by an operator. The metal sheet is pushed into the bending machine up to the stops 11, so that the metal sheet is between the upper beam 13 and the lower beam 14. The upper beam can be moved vertically downwards by means of the hydraulic pump 9 to the lower beam.

Four upper tools 15 (only partially designated by reference signs) with different widths are suspended in the upper beam 13 as an example. The upper tools each have a front edge 15*a*, which acts on the inserted metal sheet as part of the bending process when the upper beam 13 moves downwards. The upper tools are clamped in the upper beam with a known clamping device. In the same way, four lower tools 16 (only partially designated by reference signs) with different widths are clamped in the lower beam 14 by means of a corresponding clamping device. Each lower tool 16 has a V-shaped recess 16*a*, into which the machined metal sheet is pressed by the front edges 15*a* of the upper tools 15 during the bending process. This causes the metal sheet to be bent.

Figure 5:
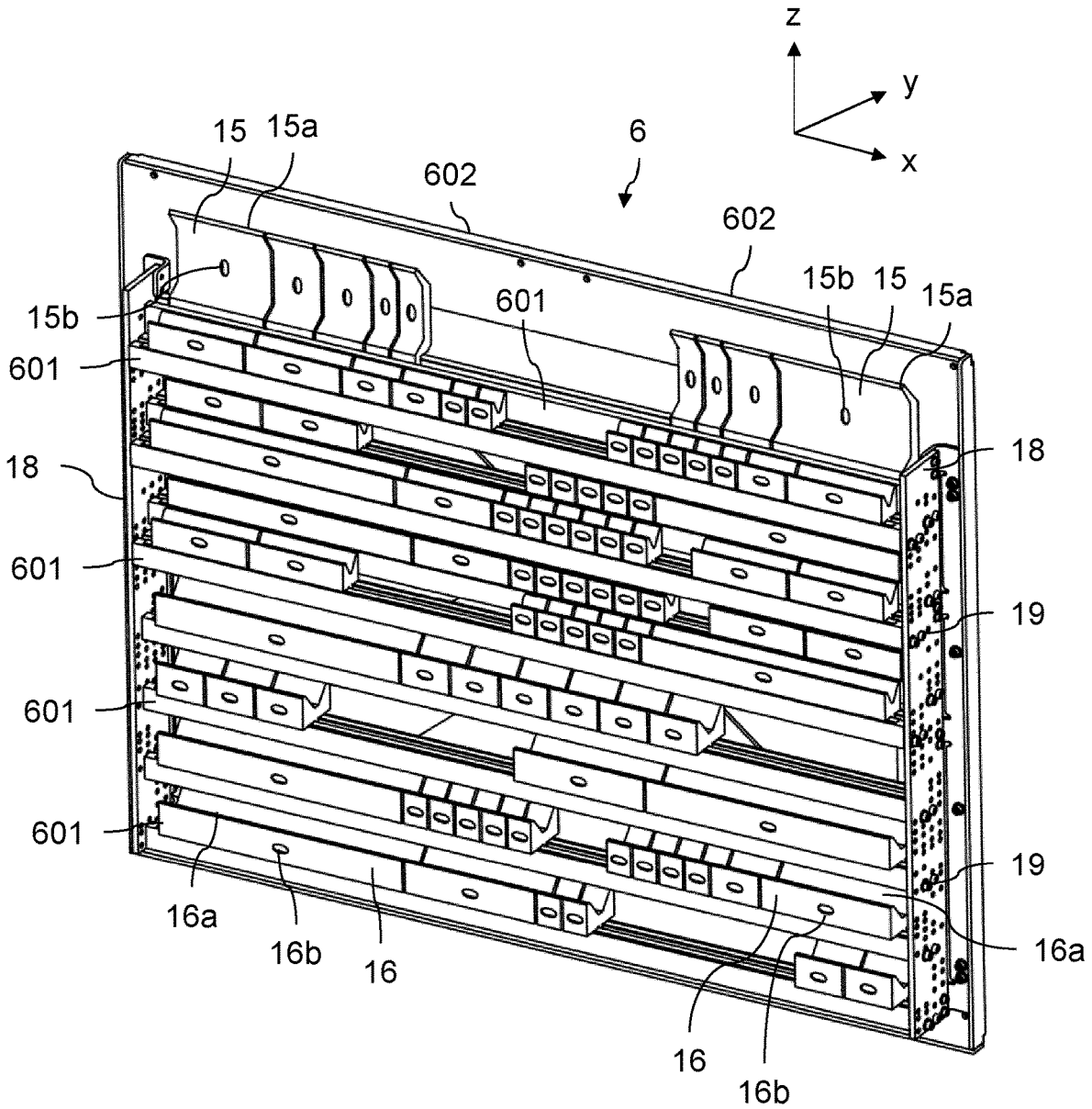
FIG. 5 shows a perspective detail view of one of the tool magazines of the changing device from FIG. 1 with bending tools stored therein.

In order to carry out different metal sheet processing steps by the bending machine 2, it is necessary to replace the upper tools and lower tools, wherein this exchange takes place automatically with the robot 4 of the changing device 1. For transporting the individual lower tools or upper tools with the gripping device 401 of the robot 4, corresponding grooves 15*b* or 16*b* are provided on one side surface of these tools. These grooves can be seen in more detail from FIG. 5 described below. For the sake of clarity, the grooves in FIG. 5 are only partially provided with reference signs. Likewise, only corresponding reference signs are used in FIG. 5 to designate the upper and lower tools 15 and 16 as well as the front edge 15*a* and the V-shaped recess 16*a*.

In a manner known per se, the grooves 15*b* and 16*b* have undercuts. For gripping an upper tool or lower tool, the front ends of the gripping blocks of the gripping device 401 have a shape corresponding to the undercuts. In order to hold a tool, the gripping blocks are moved together so that their front ends can be inserted into the corresponding groove 15*a* or 16*b*. After being inserted into the grooves, the gripper blocks move apart so that their front ends penetrate the corresponding undercuts. This causes the upper tool or lower tool to be held on the gripping device 401. In this extended state of the gripping blocks, the corresponding bending tool can then be removed from the tool magazine and suspended in the upper beam 13 or inserted into the lower beam 14. After insertion, the clamping in the upper beam and lower beam can be effected with an appropriate clamping device. In the same way, bending tools can be removed from the upper beam and lower beam by engaging the gripping blocks of the gripping device 401 in the corresponding grooves and stored in a tool magazine.

FIG. 5 again shows the structure of one of the extendable tool magazines 6 of the changing device 1 in detail. The tool magazine 6 contains the magazine frame 602, in which a multitude of receptacles 601 is located. The uppermost receptacle of the tool magazine is used for storing upper tools 15 with different widths, wherein the front edge 15*a* of the respective upper tools is directed upwards during storage. Corresponding profiles 15*c* (see FIG. 8) of the upper tools 15 are inserted in the receptacles. Grooves 15*b* are provided on both sides for the upper tools 15, so that the upper tools can be gripped from two sides and consequently can be suspended in the upper beam 13 in two different positions rotated about 180°. To make this possible, the gripping station 5 already mentioned is provided, which will be described in more detail below.

The receptacles arranged below the uppermost receptacle are used in the tool magazine 6 from FIG. 5 for storing lower tools 16 of different widths. As already mentioned, these lower tools have a V-shaped profile 16*a* on the top side. There is also a corresponding groove 16*b* on one side of each lower tool. In contrast to the upper tools, no grooves are provided on the opposite side of the respective lower tools because the lower tools are always inserted into the lower beam 14 with the same orientation. The individual lower tools 16 have a downwardly projecting projection (not visible) on their underside. This projection is clamped in the lower beam 14 with a corresponding clamping device. Other divisions of the tool magazines, for example to accommodate more than just one row of upper tools, are possible To attach the receptacles 601 in the magazine frame 602 of the tool magazine 6, two support struts 19 are screwed into the magazine frame. The support struts contain a multitude of holes through which variable positioning of the receptacles 601 is achieved using screws 19 (only partially designated by reference signs). Threaded holes are provided on the end faces of the receptacles for attaching the same. A respective receptacle is positioned at a desired position between the support struts 18 and then attached by inserting two screws 19 through corresponding holes in each support strut 18 and screwing them into the corresponding threaded holes in the receptacle.

Figure 6:
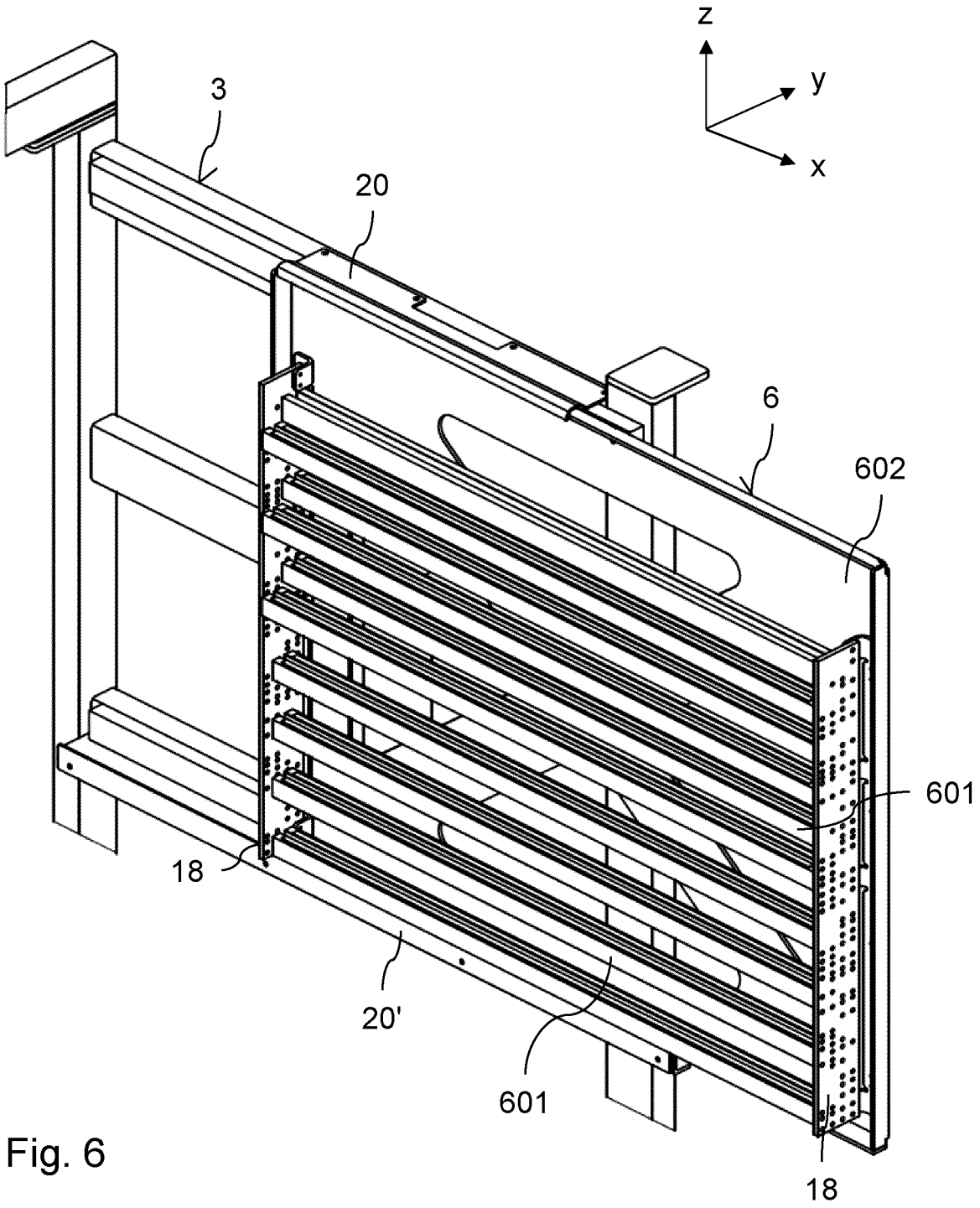
FIG. 6 shows a perspective detail view of one of the tool magazines of the changing device from FIG. 1 in the extended state without any stored bending tools.

FIG. 6 shows a perspective detail view of one of the tool magazines 6 of the changing device 1 in the extended state and without any bending tools contained therein. To move or displace the tool magazine 6, an upper guide rail 20 and a lower guide rail 20' are attached to the frame 3. An upper edge of the magazine frame 602 is received in the upper guide rail 20, whereas a lower edge of the magazine frame 602 is positioned in the lower guide rail 20'. By exerting force in the horizontal direction on the tool magazine, the tool magazine is pushed into or pulled out of the frame 3.

Figure 7:
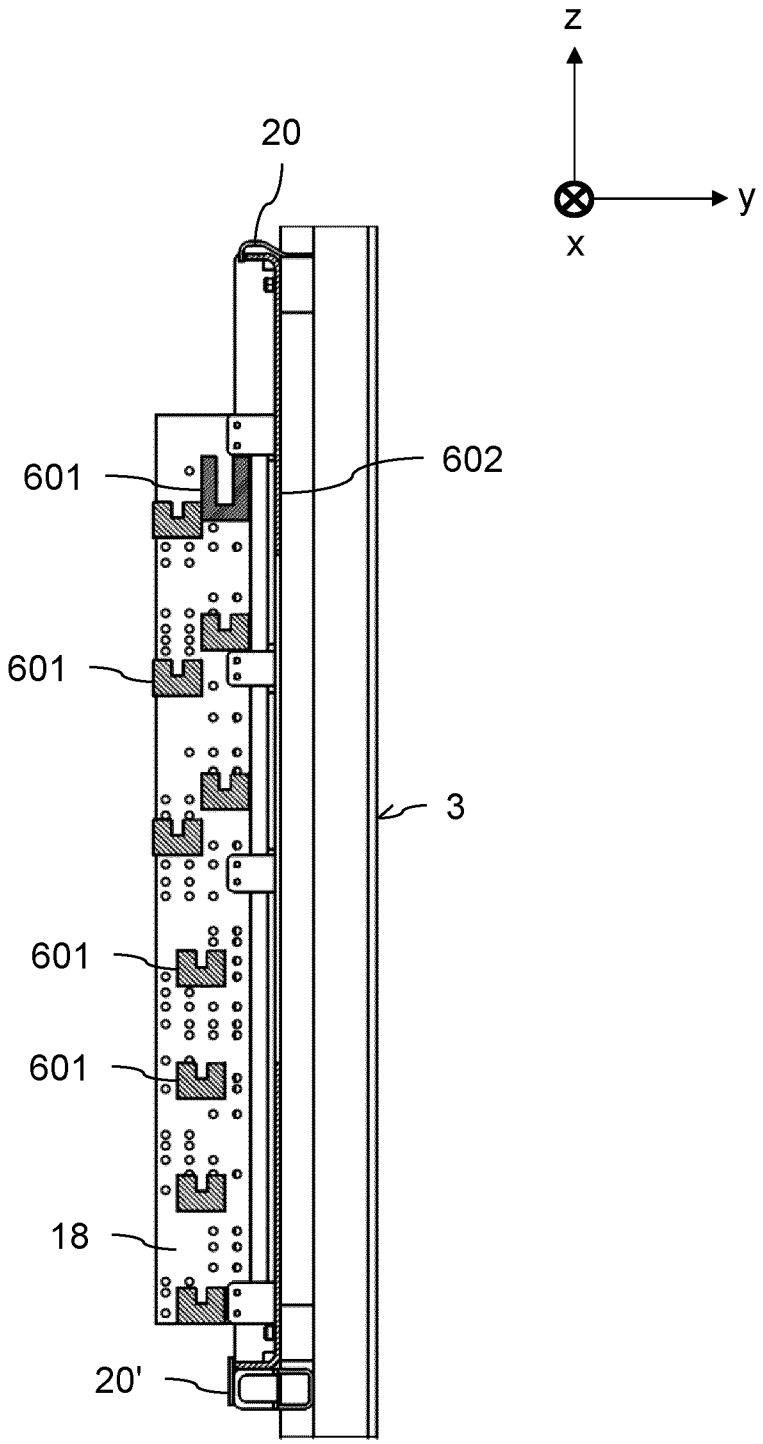
FIG. 7 shows a cross-sectional view of the tool magazine from FIG. 6.

FIG. 7 shows a cross-sectional view of the tool magazine from FIG. 6. This figure particularly highlights the two guide rails 20 and 20', which each receive an upper side or lower side of the magazine frame 602. Furthermore, FIG. 7 shows the cross section of the receptacles for storing the bending tools. The uppermost receptacle is only intended for upper tools, whereas the remaining receptacles in this arrangement example are used for storing lower tools. All the receptacles 601 have a U-shaped profile, but the depth of the U-shaped profile for the uppermost receptacle is greater than in the other receptacles due to the different shape of the upper tools.

FIG. 8 again shows a detail view of the gripping station 5 shown in FIG. 1, which is attached to a horizontal strut 303 in the upper region of the frame 3. As can be seen, the gripping station 5 has several struts 501, 502 and 503. The strut 502 extends in the horizontal direction and its free end is attached to the horizontal strut 303 of the frame 3, for example by means of a welded connection. A vertically running strut 503 adjoins the strut 502. A horizontally running strut 501 in turn extends from the lower end of the strut 503. A U-shaped receptacle 504 is located on this strut. A corresponding upper tool 15 with its profile 15*c* can be positioned in this receptacle. The upper tool for use in the bending machine 2 is suspended in the upper beam 13 via this profile and then clamped.

If an upper tool 15 is to be used starting from the position shown in FIG. 5 in the tool magazine 6 with the orientation shown in FIG. 4 (the edge 15*a* pointing into the bending machine), the gripping station 5 is not required. In this case, the upper tool can easily be removed by the gripping device 401 of the robot 4 from the uppermost receptacle 601 of the tool magazine 6 by engaging in the groove 15*b* and can then be inserted into the upper beam 13.

Figure 8:
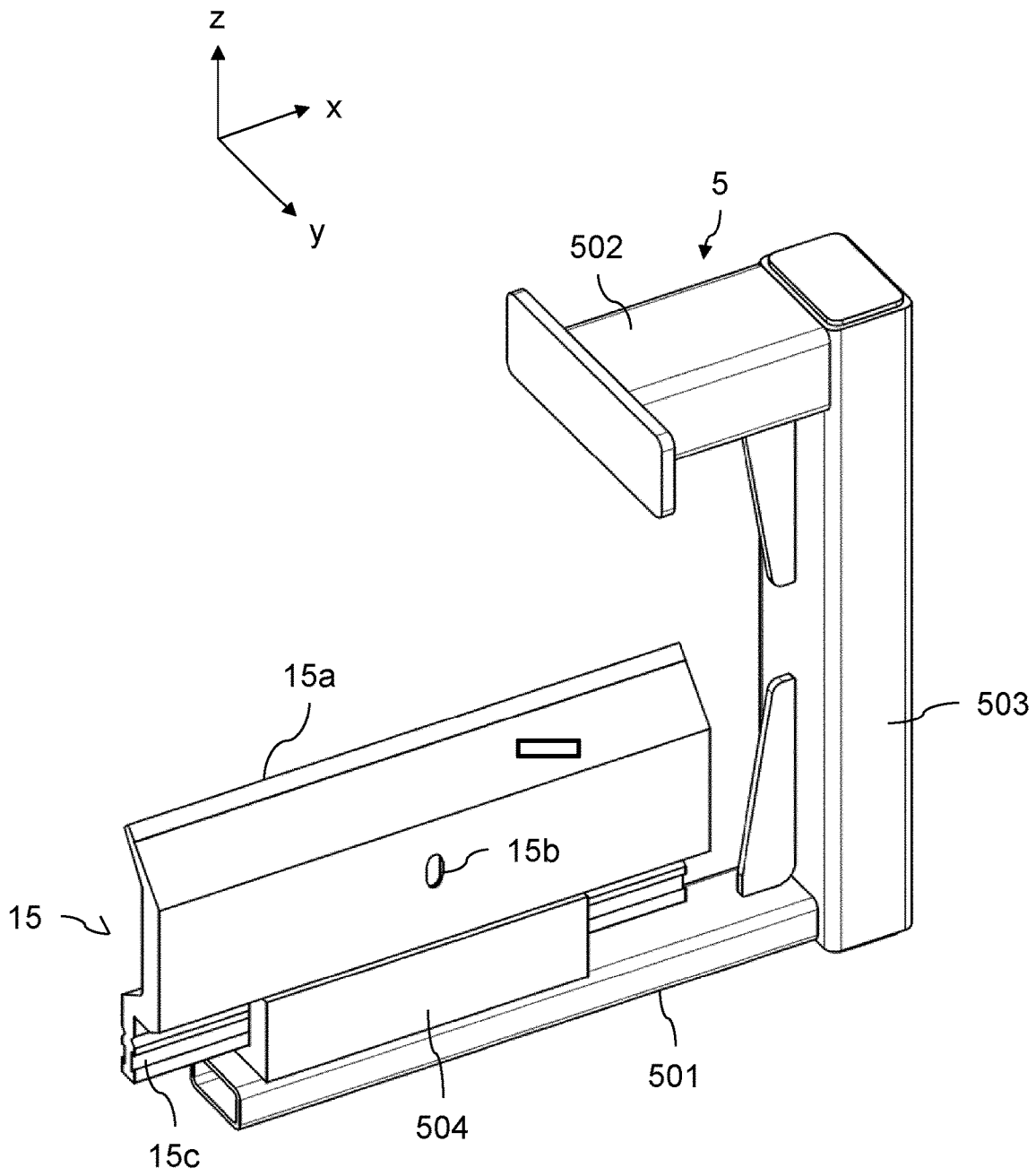
FIG. 8 shows a perspective detail view of the gripping station of the changing device from FIG. 1.

If, however, the upper tool is to be positioned rotated about 180° in the upper beam 13, the gripping station 5 from FIG. 8 is required. The robot then removes the upper tool from the receptacle 601 via the corresponding groove 15*b* and temporarily places it in the receptacle 504 of the gripping station 5. As can be seen from FIG. 8, a second groove 15*b* is provided on the rear side of the upper tool. After the upper tool has been placed in the receptacle 504, the upper tool is released by moving the gripping blocks of the gripping device 401 together. The robot then moves to the groove 15*b* shown in FIG. 8 and grips the upper tool by moving the gripping blocks of the gripping device 401 apart when the front ends of the gripping blocks are in the groove 15*b*. The gripped upper tool 15 is then moved to the upper beam 13, wherein the upper tool is now rotated about 180° in comparison to the position indicated in FIG. 4 and inserted into the upper beam.

In a modified embodiment, a turning station (not shown) is provided instead of the gripping station 5. In the same way as the gripping station, the turning station has a receptacle for the temporary storage of bending tools by the robot, wherein the receptacle is now able to be rotated about 180° automatically about a vertical axis by a suitable actuator. After the receptacle has rotated, the robot can then grip the bending tool from the other side of the bending tool without having to change its position. The turning station can, if necessary, be arranged at a different location than the gripping station 5. For example, the turning station can be attached to the bending machine 2.

Figure 9:
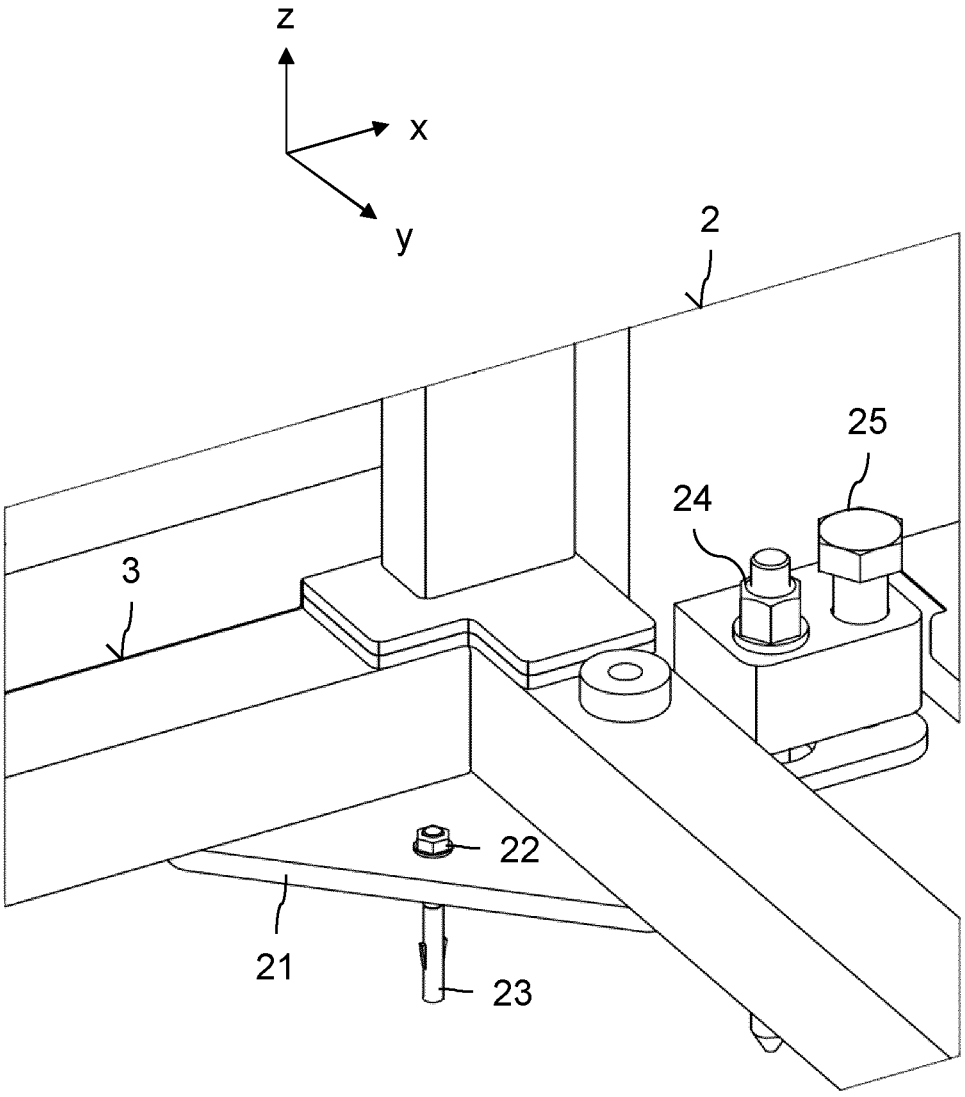
FIG. 9 shows a perspective detail view which illustrates the anchoring of the changing device from FIG. 1 on the floor.

FIG. 9 shows a perspective detail view of the attachment of the frame 3 of the changing device 1 in one of the four lower corners of the frame, wherein a corresponding attachment is provided in each corner. As can be seen from FIG. 9, a triangular base plate 21 is provided in the corresponding corner of the frame. There is a hole in this base plate through which a screw 22 is inserted, which is then connected to a dowel 23 anchored in the floor. Because anchoring in the floor is provided in each corner of the frame 3, the changing device is reliably fixed to the corresponding operating position. The corresponding corner of the bending machine 2 can also be seen from FIG. 9. It can be seen in particular that there is no mechanical contact between the bending machine 2 and the frame 3. The bending machine 2 is screwed into a dowel (not shown) in the floor by means of a screw 24, in the same way as the frame 3. This anchoring is in turn carried out in every corner of the bending machine in order to thereby fix the bending machine to the floor. In addition, adjusting screws 25 are provided in each corner of the bending machine, with which the inclination of the bending machine in relation to the floor can be suitably adjusted.

The process of storing bending tools in a corresponding tool magazine and the process of removing the bending tools from the tool magazine are described below. The storage and retrieval takes place automatically using the control module of the changing device 1 mentioned above. The control module in the form of a PLC (programmable logic controller) has a communication interface via which the control module is connected to a control device (also a PLC) of the bending machine 2 for communication purposes. In this way, it is possible that the bending processes and the changing processes are coordinated.

A sensor device in the form of a distance measuring sensor (for example a laser distance measuring sensor) is provided in the area of the gripping device 401 of the robot 4 in order to store corresponding bending tools in a tool magazine 6 or 6'.

Bending tools to be stored are first positioned in the upper beam or lower beam of the bending machine 2 by the system operator. The operator then starts a program for storing bending tools, which is executed by the control module of the changing device 1. The operator can operate the control module via a user interface in the form of a panel (not shown) provided on the bending machine. Via this user interface, the operator can also select corresponding bending programs of the control device of the bending machine 2.

As part of the program for storing bending tools, the robot 4 moves to the area of the bending machine where new bending tools can be located. Said robot searches this area for bending tools using the sensor device. The sensor data of the sensor device identify the type and the width of the corresponding bending tools. The robot then removes each tool individually with its gripping device 401 and stores it in one of the two extended side tool magazines 6 or, if applicable, also in the rear tool magazine 6'.

Conversely, the robot can also use a corresponding program of the control module to remove bending tools from the corresponding tool magazine if the operator so requests. Tools can be output individually or, if necessary, all tools of a specific type or from a certain tool magazine can be issued by the robot removing the corresponding bending tools from the tool magazine and positioning them in the upper beam or lower beam.

If the operator selects a bending program on the panel of the bending machine 2, an automatic tool change is first started by means of the control module of the changing device 1. The robot 4 removes bending tools that are no longer required from the upper or lower beam and places them in the corresponding tool magazines. The robot removes any additional tools required from the tool magazines and therewith loads the upper or lower beam of the bending machine. Once all tools have been installed, the tools are automatically clamped in the upper and lower beams with the appropriate clamping devices. The bending process can then be carried out by means of the control device of the bending machine 2 based on the selected bending program.

The embodiments of the invention described above have a number of advantages. In particular, a modular changing device is created in a simple manner, which can be arranged mechanically decoupled adjacent to the rear side of a bending machine in order to effect the changing of bending tools from there. In this way it is ensured that shocks and vibrations are not directly transmitted directly between the changing device and the bending machine. Bending tools that are not required are stored in appropriate tool magazines via the robot. In order to ensure good access to the bending tools for the robot, the tool magazines can be moved out of the changing device into the interior of the bending machine without the tool magazines and the bending machine coming into contact. The corresponding tool magazines can be extended manually by an operator when setting up the changing device on the rear side of the bending machine. However, this process can also be accelerated by allowing the tool magazines to extend automatically.

LIST OF REFERENCE SIGNS

1 Changing device
2 Bending machine
201 Front side of the bending machine
202 Rear side of the bending machine
3 Frame of the changing device
301 Opening area of the frame
302, 303 Struts of the frame
4 Robot
401 Gripping device of the robot
5 Gripping station
501, 502, 503 Struts of the gripping station
504 Receptacle of the gripping station
6, 6' Tool magazines
601 Receptacles of a tool magazine
602 Magazine frame
7 Formwork
8, 8' Side stand
9 Hydraulic pump
10, 10' Side formworks
11 Stops
12 Metal sheet supports
13 Upper beam
14 Lower beam
15 Upper tool
15*a* Front edge of the upper tool
15*b* Groove of the upper tool
15*c* Profile of the upper tool
16 Lower tool
16*a* V-shaped recess of the lower tool
16*b* Groove of the lower tool
17 Posts
18 Support struts
19 Screws
20, 20' Guides
21 Base plate
22 Anchoring screw
23 Dowel
24 Anchoring screw
25 Adjusting screw

The invention claimed is:

1. A device for changing bending tools in a bending machine for bending metal sheets, the device comprising:

a frame;

at least one rail;

a robot; and at least one tool magazine for storing the bending tools, which, when positioned in a working area of the bending machine, cause the metal sheets to bend, wherein the at least one tool magazine is arranged on the frame that is configured to be positioned in a free-standing manner without a mechanical connection to the bending machine in an operating position of the device, wherein the robot is arranged on the frame for automatically inserting the bending tools from the at least one tool magazine into the working area of the bending machine and for automatically storing the bending tools from the working area in the at least one tool magazine, wherein the robot, during operation of the device, moves in the operating position between the at least one tool magazine and the working area of the bending machine, in order to automatically insert and automatically store the bending tools, wherein the at least one tool magazine can be moved via the at least one rail out of the frame from a first position into a second position, in which at least a part of the tool magazine that can be moved out of the frame into the bending machine in a contact-free manner relative to the bending machine.

2. The device according to claim 1, wherein, in the operating position of the device, the working area is reached by the robot via a rear side of the bending machine, wherein the rear side is opposite a front side of the bending machine, via which the metal sheets to be bent are fed to the work area during operation of the bending machine.

3. The device according to claim 1, wherein the at least one tool magazine that can be moved out is displaceably guided into the frame.

4. The device according to claim 1, wherein the at least one tool magazine that can be moved out can be moved out of the frame manually or automatically.

5. The device according to claim 1, wherein the at least one tool magazine that can be moved out is assigned a fixing device for fixing the tool magazine to the frame in the moved-out state.

6. The device according to claim 1, further comprising a plurality of tool magazines that include the at least one tool magazine, wherein the plurality of tool magazines can be moved out of the frame, wherein the plurality of tool magazines are arranged on one or a plurality of inner sides of the frame, which adjoin an opening area of the device.

7. The device according to claim 1, wherein, in addition to the at least one tool magazine that can be moved out, at least one further tool magazine is provided which is immovably attached to the frame, wherein the at least one further tool magazine is arranged on an inner side of the frame, which lies opposite an opening area of the device.

8. The device according to claim 1, wherein the robot is a multi-axis robot having a plurality of robot axes and joints between the robot axes and a gripping device for gripping a bending tool.

9. The device according to claim 8, wherein the device is assigned a gripping station for temporarily receiving the bending tool during a gripping action of the robot and/or a turning station for temporarily receiving the bending tool and for automatically turning the bending tool that has been temporarily received.

10. The device according to claim 1, the device is assigned an anchoring means for anchoring the device to the floor in the operating position.

11. The device according to claim 1, wherein the device comprises a control module for the robot.

12. The device according to claim 11, wherein the control module contains a communication interface, via which the control module can communicate with a control device of the bending machine.

13. The device according to claim 11, wherein the robot includes a sensor device, wherein the control module is able to control the robot for storing the bending tools in such a way that the robot detects bending tools to be stored in the working area of the bending machine by means of the sensor device and subsequently transports the bending tools to be stored from the working area into a tool magazine.

14. An arrangement comprising a bending machine and a device for changing bending tools, wherein the device includes a frame, at least one rail, and at least one tool magazine for storing the bending tools, which, when positioned in a working area of the bending machine, cause the metal sheets to bend, wherein the at least one tool magazine is arranged on the frame which is positioned in a free-standing manner without a mechanical connection to the bending machine in an operating position of the device, wherein the robot is arranged on the frame for automatically inserting the bending from the at least one tool magazine into the working area of the bending machine and for automatic storage of the bending tools from the working area in the at least one tool magazine, wherein the robot, during operation of the device, moves in the operating position between the at least one tool magazine and the working area of the bending machine, in order to automatically insert and automatically store the bending tools, wherein the at least one tool magazine can be moved out of the frame via the at least one rail from a first position into a second position, in which at least a part of the tool magazine that can be moved out of the frame into the bending machine in a contact-free manner relative to the bending machine.

15. The arrangement according to claim 14, wherein, in the operating position of the device, the working area is reached by the robot via a rear side of the bending machine, wherein the rear side is opposite a front side of the bending machine, via which the metal sheets to be bent are fed to the work area during operation of the bending machine.

* * * * *